United States Patent [19]

Schrems

[11] 4,358,109

[45] Nov. 9, 1982

[54] ADJUSTABLE EXERCISE BENCH

[76] Inventor: James M. Schrems, 8650 Ederer Rd., Saginaw, Mich. 48603

[21] Appl. No.: 205,624

[22] Filed: Nov. 10, 1980

[51] Int. Cl.[3] ..... A63B 23/02

[52] U.S. Cl. ..... 272/144; 272/134; 272/DIG. 4

[58] Field of Search ..... 272/93, 109, 116–118, 272/134, 144, 145, 122; 5/62, 66

[56] References Cited

U.S. PATENT DOCUMENTS

| | | | |
|---|---|---|---|
| 2,562,339 | 7/1951 | Socol | 272/144 X |
| 2,783,045 | 2/1957 | Bosch | 272/144 X |
| 2,831,687 | 4/1958 | Hunter | 272/145 |
| 3,892,404 | 7/1975 | Martucci | 272/134 |
| 3,949,983 | 4/1976 | Tommasino | 272/144 |
| 4,098,502 | 7/1978 | Faust | 272/144 |
| 4,286,782 | 9/1981 | Fuhrhop | 272/134 X |

*Primary Examiner*—Richard C. Pinkham
*Assistant Examiner*—Stephen R. Crow
*Attorney, Agent, or Firm*—Learman & McCulloch

[57] ABSTRACT

Exercise apparatus comprises a frame having a base portion and an upright portion. A seat member and a back member are pivoted to one another at confronting ends and the seat member is provided with pivoted supporting legs which also are pivoted to the base portion of the frame. The back member is provided with supporting arms which may be accommodated in any one of a number of socket-like retainers carried by the upright portion of the frame. The construction and arrangement are such that the seat and back members may be located in any one of a number of different positions relative to one another to facilitate the performance of different kinds of exercises.

8 Claims, 6 Drawing Figures

ADJUSTABLE EXERCISE BENCH

BACKGROUND OF THE INVENTION

Apparatus constructed in accordance with the invention comprises an exercise device which enables a person to position his body in such manner as to facilitate the performance of a variety of exercises. Apparatus of the kind to which the invention relates conventionally is referred to as an exercise bench and is adapted for use in a gymnasium or in one's home.

Some forms of exercise require the body to assume a sitting position, whereas other exercises require the body to be reclined, either horizontally or at an inclination to the horizontal. Apparatus constructed according to the invention enables the body to be located in any selected one of these positions without necessitating dismantling or replacement of any of the component parts of the apparatus.

SUMMARY OF THE INVENTION

Exercise apparatus constructed in accordance with the invention comprises a frame having an upright portion and a horizontal, base portion. A seat portion is located above the base portion of the frame and is coupled to the latter by pivoted legs. A back member is pivoted to the seat member and is provided with pivoted arms which may be accommodated in any selected one of a number of retainer sockets carried by the upright portion of the frame. The construction and arrangement of the seat and back members, the pivoted legs and arms, and the sockets are such that the seat and back members may assume positions in prolongation of one another in either a horizontal or inclined plane. In addition, the seat and back members may be adjusted relatively to one another to form a chair-like support.

DESCRIPTION OF THE DRAWINGS

Apparatus according to a preferred embodiment of the invention is illustrated in the accompanying drawings, wherein.

THE PREFERRED EMBODIMENT

Figure 2:
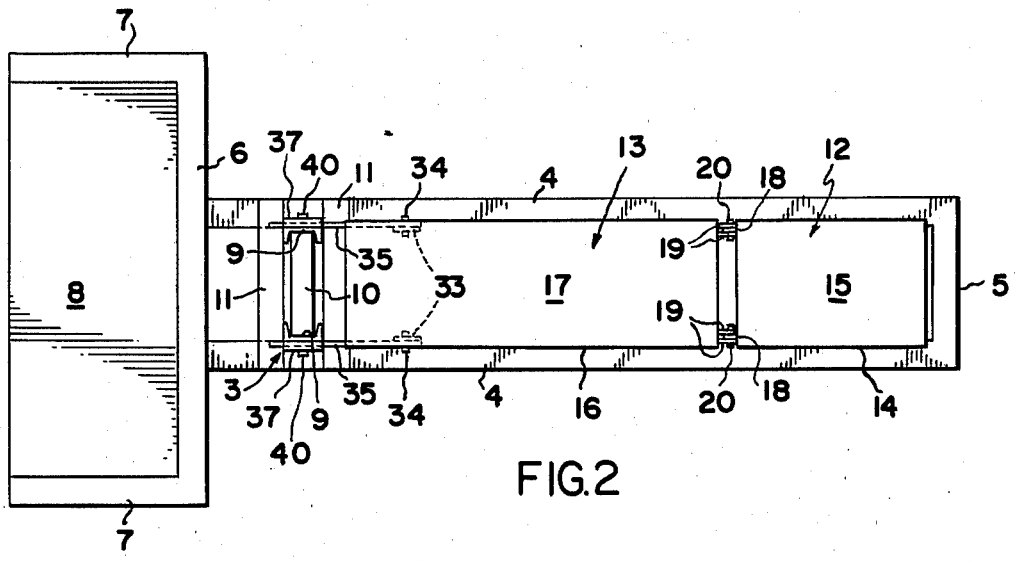
FIG. 2 is a top plan view.

The preferred embodiment of exercise apparatus comprises a main frame 1 having a horizontal base portion 2 and an upright portion 3 extending above the base portion. The base portion comprises a pair of parallel frame members 4 joined at one end by a cross member 5 and joined at the opposite end by an elongate cross member 6 which extends transversely beyond both frame members 4. The ends of the cross members 6 are joined to end members 7 which are spanned by a plate 8 on which a person may stand. The upright frame portion 3 comprises a pair of spaced, parallel, upstanding beams 9 joined at corresponding ends by cross bars 10. Suitable reinforcements 11 rigidify the connection of the upright frame portion to the base.

The apparatus includes a pair of body supporting members 12 and 13 which hereinafter will be referred to as seat and back members, respectively. The seat member 12 has a rectangular frame 14 provided with an upper plate 15 which may be padded, if desired. The back member 13 has a longer rectangular frame 16 and an upper plate 17 which also may be padded. The confronting ends of the members 12 and 13 have ears 18 and 19, respectively, through which pivot pins 20 extend to enable the seat and back members to be swung through substantially 180° relatively to each other.

Adjacent the rear end of the seat member, i.e., that end which confronts the back member 13, the frame 14 is fitted with a pair of depending ears 21 to each of which is pivoted, by a pin 21*a*, a fixed length supporting leg 22. The opposite end of each leg 22 is pivoted to the corresponding base frame member 4 by means of a pivot pin 23. At the forward end of the seat member 12, and substantially midway between the sides thereof, is a depending ear 24 to which one end of an adjustable length support leg 25 is pivoted by means of a pin 26. The leg 25 has a first section 27 in which a second section 28 slidably and telescopically is accommodated. The lower end of the leg 28 is pivoted by a pin 29 to a mounting ear 30 that underlies the ear 24 and is fixed to the frame member 5. The section 28 has a number of openings 31 therein any one of which may be aligned with an opening in the section 27 and through which an anchor pin 32 may pass so as to secure the sections 27 and 28 in a selected position of longitudinal adjustment.

The free or rear end of the back member 13 has a pair of depending ears 33 secured to the frame 16 and to each of which is pivoted, by a pin 34, one end of a supporting arm 35. The opposite end of each arm is free and is adapted to be accommodated in any one of three hollow retainers or sockets 37, 38, 39, fixed to the upright frame members 9. The free end of each arm 35 has an opening for the removable accommodation of an anchor pin 40. Each retainer has an opening 41 in which the associated anchor pin may be accommodated.

At the forward end of the back member 13 the frame 16 has fixed thereto a pair of elongate, auxiliary support members or braces 42 which extend beyond the forward end of the back member 13 and underlie the frame 14 of the seat member 12. The purposes of the braces 42 will be explained hereinafter.

Figure 1:
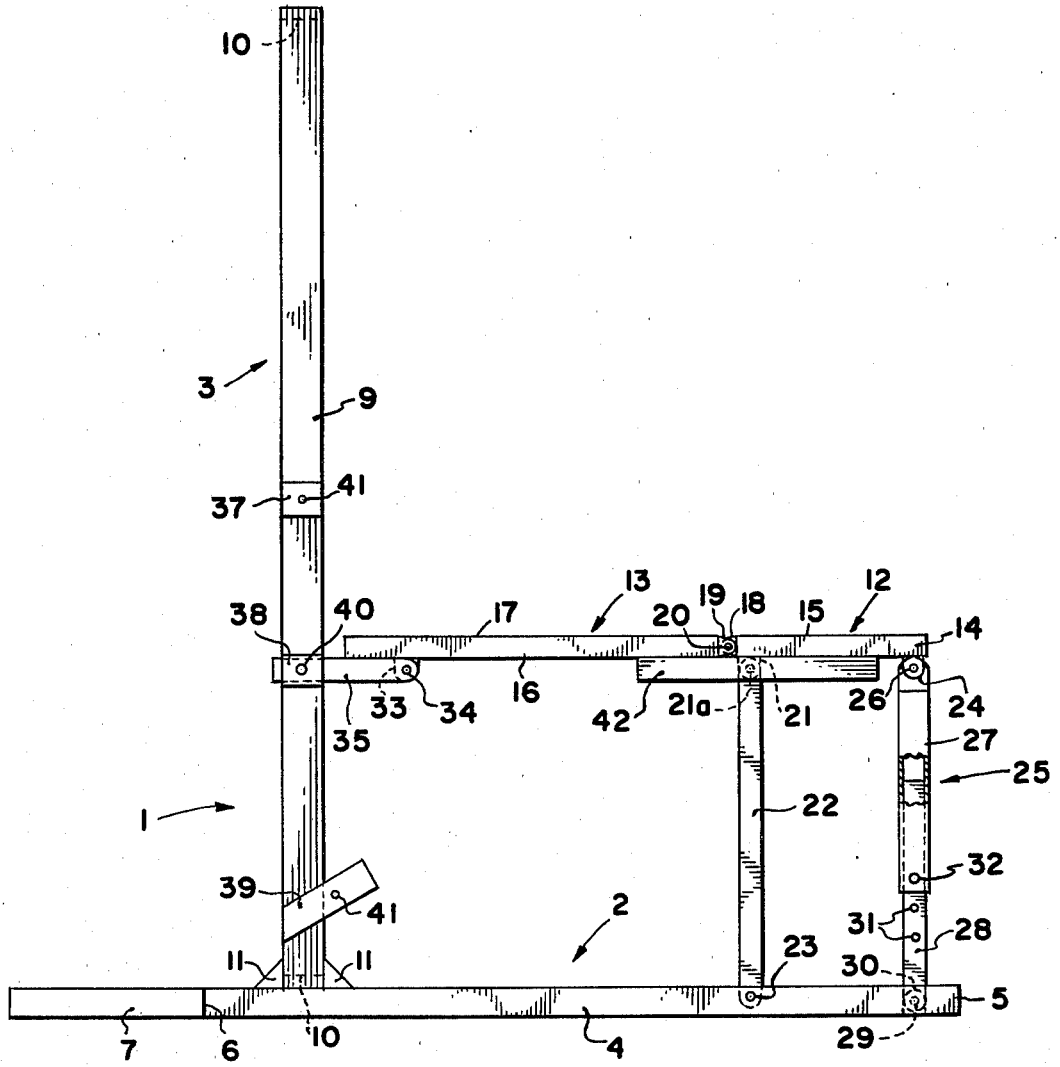
FIG. 1 is a side elevational view of the apparatus and illustrating the body-supporting members in one position of relative adjustment.

When the parts of the apparatus are in the positions shown in FIGS. 1 and 2, the seat and back members 12 and 13, respectively, extend in prolongation of one another and are substantially horizontal. The seat and back members are maintained in the horizontal position by the arms' 35 being accommodated in the retainers 38 and by the supporting legs 22. Rocking of the legs 22 is precluded by the pins 40 at the free ends of the arms 35.

In the horizontal positions of the seat and back members, the auxiliary support members 42, being fixed to the frame 16 of the back member 13, may provide support for the seat member. It is not essential, therefore, that the telescoping support leg 25 be provided when the seat and back are in their horizontal positions, but it is preferred.

Figure 4:
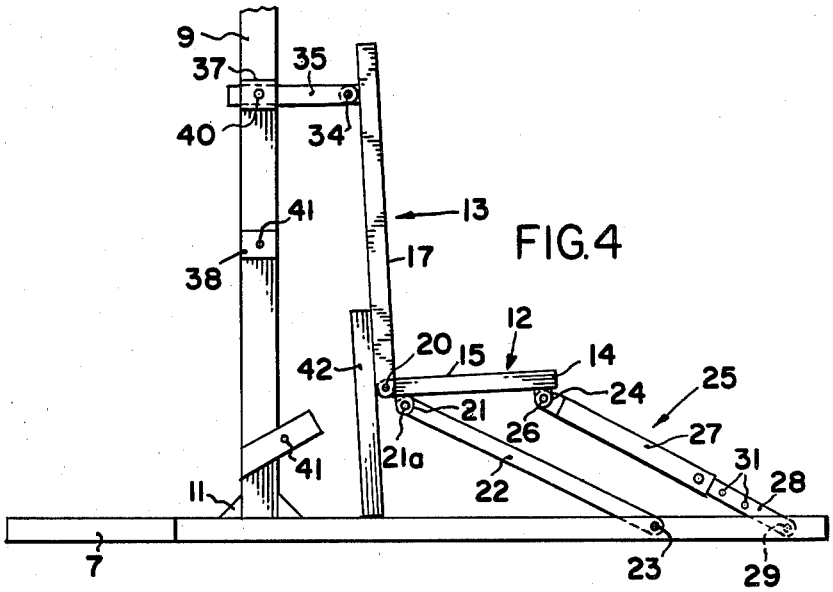
FIGS. 4, 5, and 6 are views similar to FIG. 1, but illustrating other relative positions of the body-supporting members.

The arms 35 may be withdrawn from the sockets 38 and fitted into the uppermost sockets 37, as is illustrated in FIG. 4, whereupon the back and seat members will rock relatively to one another so as to permit such members to assume a chair-like configuration. In these positions of the parts, the braces 42 will have their lower ends in engagement with the frame members 4 of the base frame, thereby providing adequate vertical and lateral stability for the apparatus.

Figure 5:
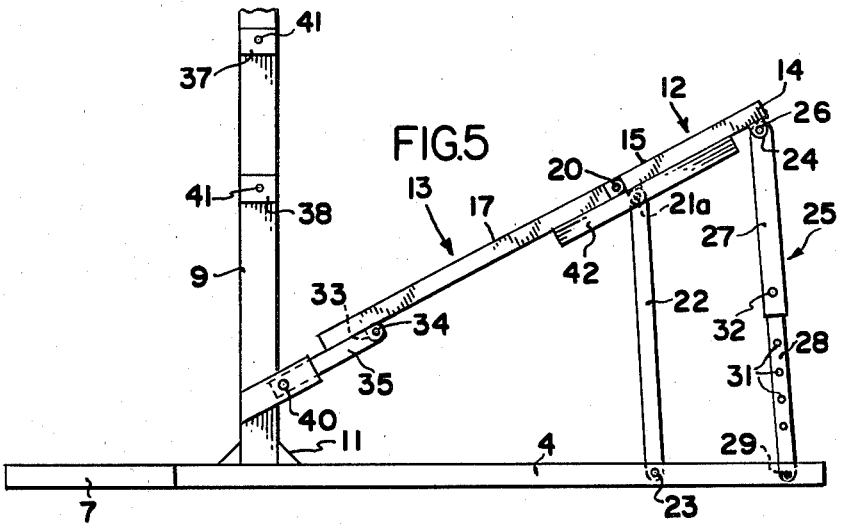

If the arms 34 are accommodated in the lowermost retainers 39, the seat and back members 12 and 13 again may extend in prolongation of one another, but at an inclination to the horizontal, as is illustrated in FIG. 5. When the members are in these positions, the telescoping support leg 27 may be elongated so as to provide rigid support for the forward end of the seat member 12.

Figure 6:
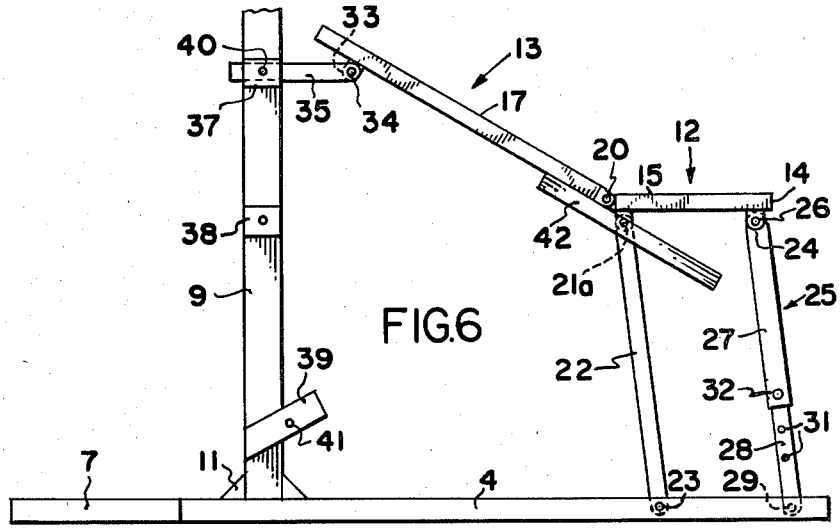
Figure 3:
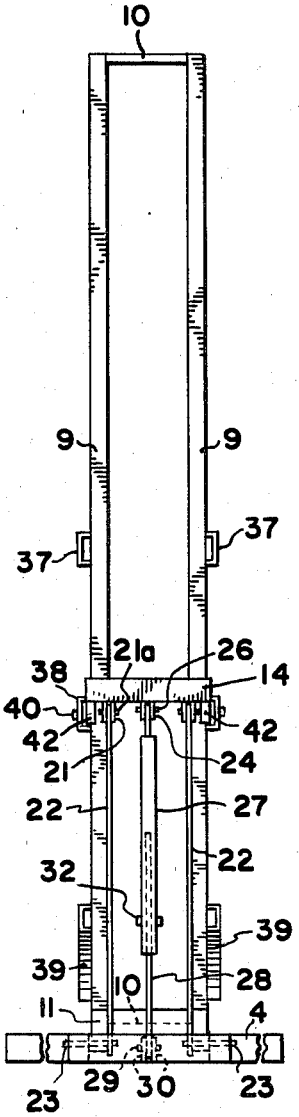
FIG. 3 is an end elevational view.

If the arms are fitted into the retainers 37 immediately above the retainers 38, then the seat and back members may assume a selected one of the reclining chair positions illustrated in FIGS. 4 and 6 in which the seat member 12 occupies a substantially horizontal position.

If the telescoping support leg 25 is shortened when the back member 13 is in the position shown in FIG. 6, the seat member 12 may occupy an inclined position in prolongation of the back member 13. Alternatively, if the support leg 25 is elongated from the condition shown in either of FIGS. 4 and 6, the seat member can be upwardly inclined.

It will be understood that various kinds of exercise attachments (not shown) may be fitted to the upright frame 3, as is customary. Since such attachments form no part of the invention per se, they are not illustrated.

The disclosure is representative of a presently preferred form of the invention, but is intended to be illustrative rather than definitive thereof. The invention is defined in the claims.

I claim:

1. An exercise device comprising a frame having a base and an upright fixed to said base and extending upwardly therefrom; a back member; a seat member; means pivotally connecting one end of said back member to one end of said seat member for relative angular adjustment of said members; support means pivotally connecting said seat member to said base for supporting said seat at any one of a selected number of different levels above said base; supporting means pivotally connected to said back member at its opposite end; and a plurality of retainer means carried by said upright at vertically spaced levels, any selected one of said retainer means being operable to secure said supporting means to said upright whereby said seat member and said back member may assume any selected one of a number of different angular positions relative to one another.

2. The device according to claim 1 wherein said support means comprises legs at opposite ends of said seat member.

3. The device according to claim 2 wherein one of said legs is adjustable in length.

4. The device according to claim 1 including brace means fixed to said back member and projecting beyond said one end thereof to provide support for said seat member in a selected relative position of said members.

5. The device according to claim 4 wherein said brace means is of such length as to engage said base portion in another selected relative position of said members.

6. The device according to claim 1 wherein said supporting means comprises arms having free ends.

7. The device according to claim 6 wherein said retainer means comprise sockets for the accommodation of the free ends of said arms.

8. The device according to claim 7 including anchor means for maintaining the free ends of said arms in said sockets.

* * * * *